US008360741B2

(12) United States Patent
Chuang

(10) Patent No.: US 8,360,741 B2
(45) Date of Patent: Jan. 29, 2013

(54) MANUAL/PNEUMATIC PUMP STRUCTURE

(76) Inventor: Chia-Chiung Chuang, Taicung (TW)

( * ) Notice: Subject to any disclaimer, the term of this patent is extended or adjusted under 35 U.S.C. 154(b) by 312 days.

(21) Appl. No.: 12/902,305

(22) Filed: Oct. 12, 2010

(65) Prior Publication Data

US 2012/0063930 A1 Mar. 15, 2012

(30) Foreign Application Priority Data

Sep. 10, 2010 (TW) ..... 99217624 U

(51) Int. Cl.

| | |
|---|---|
| ***F04F 5/52*** | (2006.01) |
| ***F04B 9/14*** | (2006.01) |
| ***B65B 1/16*** | (2006.01) |
| ***B67C 3/16*** | (2006.01) |

(52) U.S. Cl. ..... 417/185; 417/374

(58) Field of Classification Search ..... 417/65, 417/151, 162, 178, 182, 185, 190, 198, 374; 137/533.1, 895; 141/27, 28, 65, 302
See application file for complete search history.

(56) References Cited

U.S. PATENT DOCUMENTS

| | | | | |
|---|---|---|---|---|
| 6,537,036 | B1 * | 3/2003 | Broerman et al. | 417/182.5 |
| 6,558,138 | B2 * | 5/2003 | Tseng | 417/374 |
| 6,722,855 | B2 * | 4/2004 | Tien-Tsai | 417/199.1 |
| 7,093,624 | B2 * | 8/2006 | Chen | 141/65 |
| 7,367,366 | B2 * | 5/2008 | Liao | 141/26 |

* cited by examiner

*Primary Examiner* — Devon Kramer
*Assistant Examiner* — Bryan Lettman
(74) *Attorney, Agent, or Firm* — Guice Patents PLLC

(57) ABSTRACT

A manual/pneumatic pump structure includes: a barrel member having a barrel body defining a fuel collection space; a cover body disposed on the barrel body for sealing the fuel collection space; a pneumatic gas-sucking member having a main body disposed on the cover body and a Venturi tube section positioned in the main body, an inlet passage being formed in the main body in communication with an inlet of the Venturi tube section, an outlet passage being formed in the main body with a first end in communication with an outlet of the Venturi tube section, a second end of the outlet passage being permissible to communicate with the atmosphere; and an isolation section for isolating internal passage of the pneumatic gas-sucking member from the atmosphere. The isolation section has a movement space within which a stopper body is movable between a blocking position and an unblocking position.

5 Claims, 7 Drawing Sheets

10

MANUAL/PNEUMATIC PUMP STRUCTURE

BACKGROUND OF THE INVENTION

1. Field of the Invention

The present invention relates generally to a vehicle service tool, and more particularly to an improved manual/pneumatic pump structure.

2. Description of the Related Art

A conventional manual/pneumatic pump can be operated manually or pneumatically. The manual/pneumatic pump has a closed space for collecting fuel. When the air pressure in the closed space is lowered, due to the atmosphere, the fuel is sucked into the closed space to facilitate maintenance/repair of a vehicle.

FIGS. 1 and 2 show a valve assembly 90 with a float member, which is disclosed in prior art. The valve assembly 90 including a check valve 91 and a float member 92 are integrated into a one-piece member. The one-piece member is installed in an intake 94 of a vacuum generator 93, which sucks air on the basis of Venturi tube principle. Accordingly, the check valve 91 is forced by a spring 911 to make a ball member 912 normally block a bottom opening of the intake 94. Under such circumstance, the intake 94 is not in communication with the internal space 95 of the fuel collection reservoir of the manual/pneumatic pump. In this case, a user can manually operate the manual/pneumatic pump to pump the external fuel into the fuel collection space.

When the manual/pneumatic pump is operated pneumatically, the external compressed air is filled into the vacuum generator 93. Under Venturi tube effect, the air pressure in the intake 94 is lowered. At this time, the pressure in the fuel collection space 95 under the ball member 912 is higher so that the ball member 912 is pushed away. Under such circumstance, the intake 94 is in communication with the fuel collection space 95 to suck the gas out of the fuel collection space 95 and create a low-pressure environment. When the fuel in the fuel collection space 95 reaches the full level, the float member 92 moves upward due to the buoyancy, whereby the sealing washer 921 at the top of the float member 92 blocks the bottom opening of the intake 94. Accordingly, the gas in the fuel collection space 95 is prevented from being further sucked out so as not to over-pump the fuel.

When the float member 92 moves upward and the washer 921 blocks the bottom opening of the intake 94, the space S between the washer 921 and the ball member 912 is closed and kept in a near-vacuum low-pressure state. In this case, the higher pressure of the lower side of the washer 921 may hinder the washer from unblocking the bottom opening of the intake 94. As a result, it is hard for the float member 92 to drop under gravity.

SUMMARY OF THE INVENTION

It is therefore a primary object of the present invention to provide an improved manual/pneumatic pump structure, which can be operated in a manual operation mode or a pneumatic operation mode. When operated in the manual operation mode, the internal passage of vacuum generator through which the fuel collection space communicates with the atmosphere is blocked to ensure smooth movement of the float member on a full level.

To achieve the above and other objects, the manual/pneumatic pump structure of the present invention includes: a barrel member having a barrel body, the barrel body defining a fuel collection space with a top opening; a cover body disposed on the barrel body for sealing the fuel collection space; a pneumatic gas-sucking member having a main body disposed on the cover body and a Venturi tube section positioned in the main body, an inlet passage being formed in the main body in communication with an inlet of the Venturi tube section, an outlet passage being formed in the main body with a first end in communication with an outlet of the Venturi tube section, a second end of the outlet passage being permissible to communicate with the atmosphere as an opening, the main body being further formed with an intake, a first end of the intake communicating with a low-pressure section of the Venturi tube section, a second end of the intake communicating with the fuel collection space, a control section being used to control opening/closing of the inlet passage; and an isolation section for isolating internal passage of the pneumatic gas-sucking member and the fuel collection section from the atmosphere. The isolation section has a movement space with a predetermined capacity in communication with the outlet passage. A stopper body is received in the movement space. The stopper body has a volume smaller than the capacity of the movement space, whereby the stopper body is movable within the movement space between a blocking position and an unblocking position. When positioned in the blocking position, the stopper body blocks the outlet passage to isolate the outlet passage from the atmosphere. When positioned in the unblocking position, the stopper body unblocks the outlet passage, permitting the outlet passage to communicate with the atmosphere.

The present invention can be best understood through the following description and accompanying drawings, wherein:

DETAILED DESCRIPTION OF THE PREFERRED EMBODIMENTS

Figure 1:
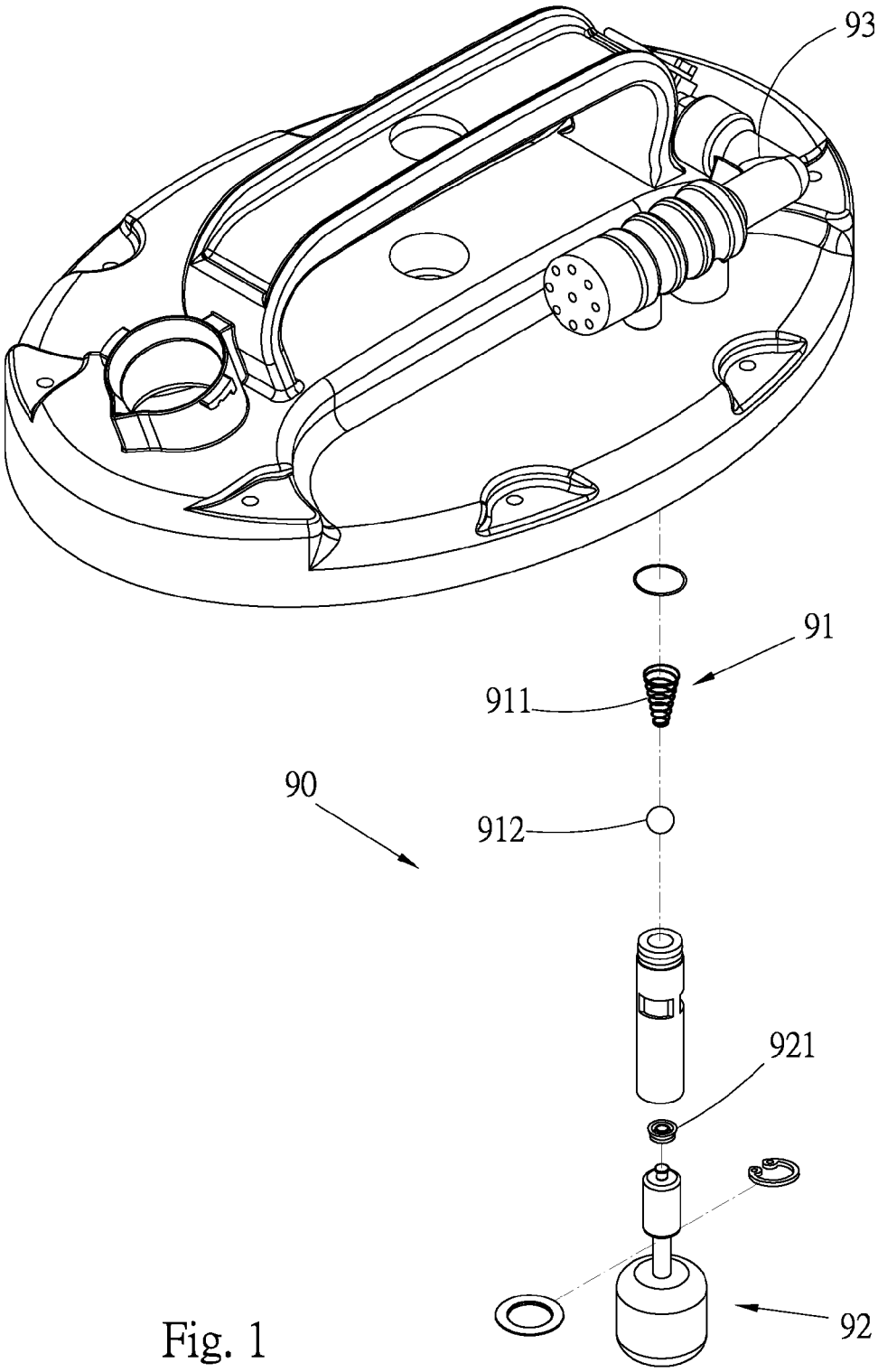
Fig. 1 PRIOR ART
FIG. 1 is a perspective exploded view of a conventional manual/pneumatic pump.

Please refer to FIGS. 3 to 8. According to a preferred embodiment, the manual/pneumatic pump structure 10 of the present invention includes a barrel member 20, a cover body 30, a pneumatic gas-sucking member 40 and an isolation section 50.

The barrel member 20 has a barrel body 21 composed of a sleeve 211 and a base 212. The barrel body 21 defines a fuel collection space 22 with a top opening.

The cover body 30 is disposed at top end of the barrel body 21 to cover the top end of the barrel body 21 and seal the fuel collection space 22. The fuel collection space 22 can be only in communication with the atmosphere via a flow way formed inside the cover body 30, the pneumatic gas-sucking member 40 and a manual pumping member 70 under control. Such technique pertains to prior art and is not included in the scope of the present invention. Therefore, this technique will not be further described hereinafter.

The pneumatic gas-sucking member 40 operates on the basis of Venturi tube principle. The Venturi tube is a short tube with a constricted, throat-like passage that increases the velocity and lowers the pressure of a fluid conveyed through it. Accordingly, there are high-pressure section and low-pressure section in the flow way. Under the low pressure of the low-pressure section, the gas in the closed fuel collection space 22 is sucked away to lower the pressure in the fuel collection space 22. This technique also pertains to prior art and thus will not be further described hereinafter. The structure related to the present invention is described as follows: The pneumatic gas-sucking member 40 has a main body 41 fixedly disposed on the cover body 30, and a Venturi tube section 42 positioned in the main body 41. An inlet passage 43 is formed in the main body 41 in communication with an inlet of the Venturi tube section 42. An outlet passage 44 is formed in the main body 41 with a first end in communication with an outlet of the Venturi tube section 42. A second end of the outlet passage 44 is formed at one end of the main body 41 as an opening. The main body 41 is further formed with an intake 45. A first end of the intake 45 communicates with the low-pressure section of the Venturi tube section 42. A second end of the intake 45 communicates with the closed fuel collection space 22. A control section 46 formed of a cock valve is fixedly connected with the main body 41 in communication with the inlet passage 43 for controlling opening/closing of the inlet passage 43.

The isolation section 50 includes a connection ring 51 having an internal space. A first axial end of the connection ring 51 is screwed on the end of the main body 41 around the opening of the outlet passage 44 with the internal space in communication with the opening of the outlet passage 44. The isolation section 50 further includes a circular end piece 52 disposed at a second axial end of the connection ring 51 to block the second axial end. An inner face of the end piece 52 is spaced from the end of the main body 41 by a restriction gap d, whereby the internal space of the connection ring 51 is sealed between the end piece 52 and the end of the main body 41. The end piece 52 is formed with several perforations 53 to communicate the internal space of the connection ring 51 with the atmosphere. Accordingly, the opening of the outlet passage 44 can communicate with the atmosphere through the internal space of the connection ring 51 and the perforations 53. A tapered dent 54 is formed on a circumferential wall of the opening of the outlet passage 44 and centered at an axis of the opening. A circular blind hole 55 is formed on the inner face of the end piece 52 opposite to the tapered dent 54. A movement space 56 with a certain capacity extends from the tapered dent 54 to the blind hole 55. A spherical stopper body 57 is received in the movement space 56. The stopper body 57 has a volume smaller than the capacity of the movement space 56 and a radius larger than the restriction gap d, whereby the stopper body 57 can move within the movement space 56 between a blocking position and an unblocking position. When positioned in the blocking position, the stopper body 57 is inlaid in the tapered dent 54 to block the opening of the outlet passage 44. Under such circumstance, the outlet passage 44 is not in communication with the atmosphere. When positioned in the unblocking position, the stopper body 57 leaves the tapered dent 54 to unblock the opening of the outlet passage 44, whereby the outlet passage 44 is in communication with the atmosphere.

According to the above arrangement, the manual/pneumatic pump structure 10 of the present invention can be manually operated or pneumatically operated as practically required. To speak more specifically, referring to FIG. 6, in a not used state, the stopper body 57 will naturally drop onto the bottom of the movement space 56 under gravity. In this case, the stopper body 57 is separated from the opening of the outlet passage 44, whereby the gas is permitted to freely flow between the outlet passage 44 and the atmosphere.

Figure 7:
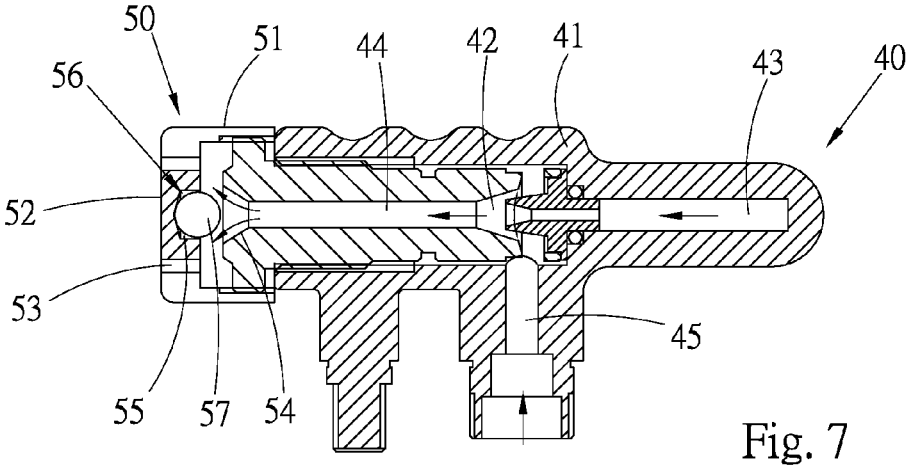
FIG. 7 is a sectional view of a part of the preferred embodiment of the manual/pneumatic pump structure of the present invention, showing that the stopper body is moved to the unblocking position under the force of airflow.

Please now refer to FIG. 7. When a user pneumatically operates the manual/pneumatic pump, the external high-pressure will enter the pneumatic gas-sucking member 40 to suck away the gas in the fuel collection space 22 under Venturi tube effect. The gas is ejected from the opening of the outlet passage 44. At this time, the stopper body 57 is pushed by the ejected high-pressure airflow to be moved far away from the opening of the outlet passage 44 and restrictedly inlaid into the blind hole 55. Under such circumstance, the pneumatic gas-sucking member 40 can operate normally.

Figure 8:
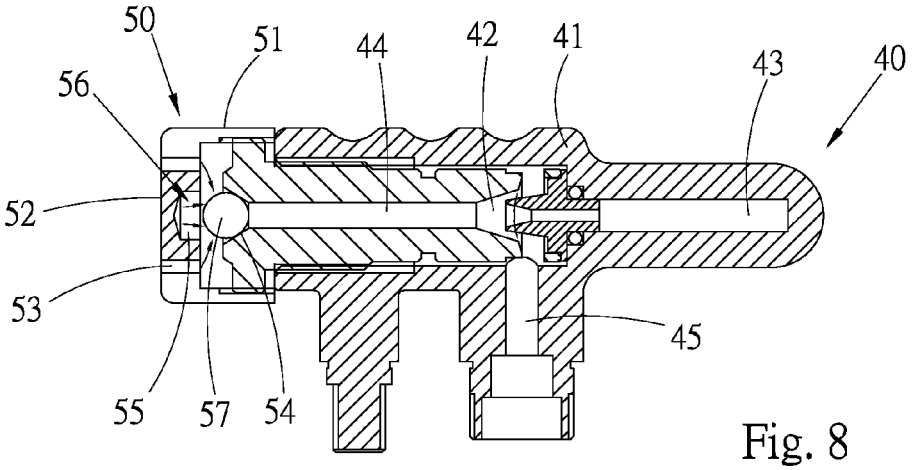
FIG. 8 is a sectional view of a part of the preferred embodiment of the manual/pneumatic pump structure of the present invention, showing that the stopper body is moved to the blocking position under the force of airflow.

Please further refer to FIG. 8. When the user manually operates the manual/pneumatic pump, the gas in the fuel collection space 22 is sucked away through the manual gas-sucking flow way. At this time, the fuel collection space 22 is still in communication with the atmosphere through the intake 45, the Venturi tube section 42 and the outlet passage 44. Accordingly, when manually sucking away the gas in the fuel collection space 22, due to pressure change, the external atmosphere reversely flows into the fuel collection space 22 through the outlet passage 44, the Venturi tube section 42 and the intake 45. When the air flows, the stopper body 57 is synchronously driven to move to the blocking position for blocking the path in which the atmosphere goes into the fuel collection space 22. Also, the control section 46 is closed to ensure that the pressure in the fuel collection space 22 can be lowered by means of manual operation.

In the above embodiment, the isolation section 50 can automatically block or unblock the outlet passage 44 in response to the change of flowing direction of the airflow. The stopper body 57 is normally kept in the unblocking position to free the outlet passage 44. Only when an activity of airflow takes place, the stopper body 57 is moved. Alternatively, according to another preferred embodiment, a resilient member such as a spring can be positioned between the stopper body and the end piece to provide resilient force for keeping the stopper body in the blocking position where the stopper body is inlaid in the tapered dent. Accordingly, the outlet passage is kept blocked in normal state. According to this arrangement, when pneumatically operating the manual/pneumatic pump, the high-pressure air will exert a high pressure to overcome the resilient force. Therefore, this embodiment can achieve the same effect as the first embodiment. When manually operating the manual/pneumatic pump, the outlet passage is already normally blocked by the stopper body so that there will be no backflow. In this case, it is ensured that the manual operation can be smoothly performed.

Figure 2:
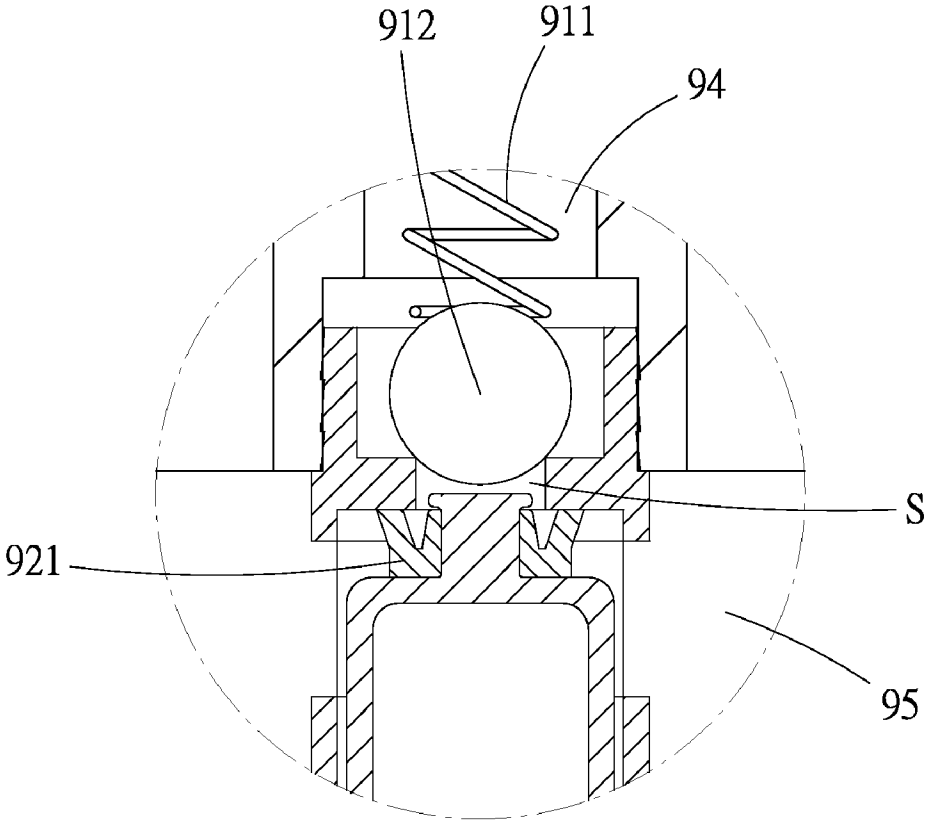
Fig. 2 PRIOR ART
FIG. 2 is a sectional view of a part of the conventional manual/pneumatic pump.
Figure 3:
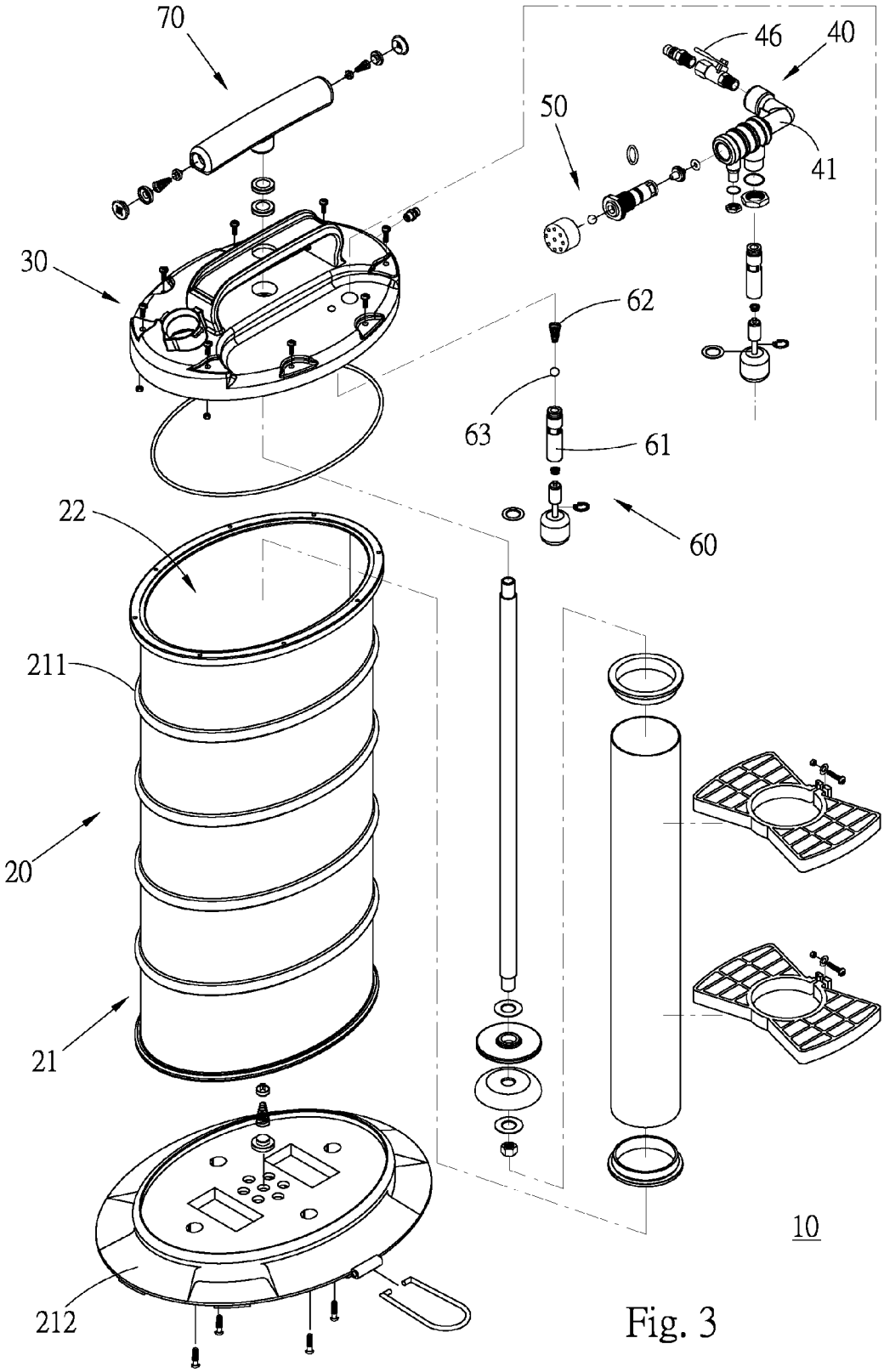
FIG. 3 is a perspective exploded view of a preferred embodiment of the manual/pneumatic pump structure of the present invention.
Figure 4:
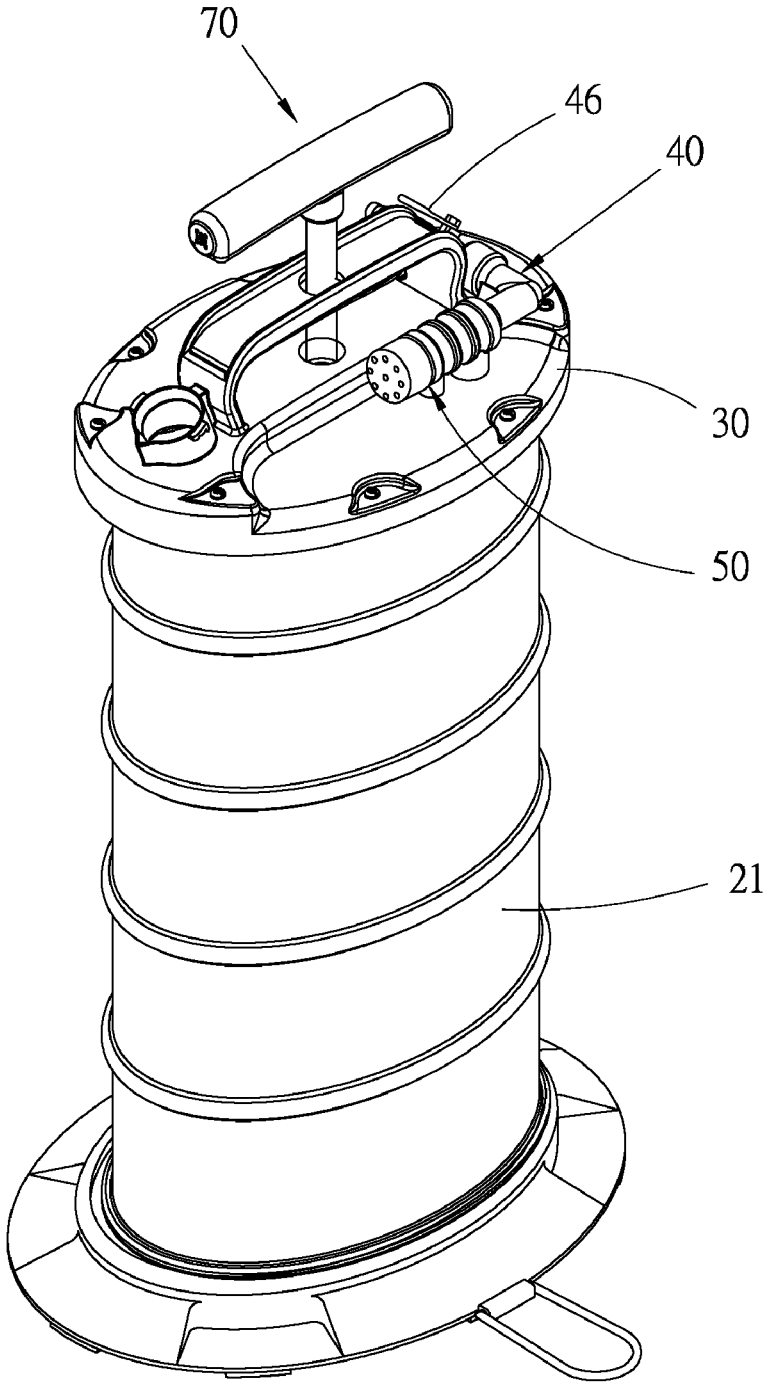
FIG. 4 is a perspective assembled view of the preferred embodiment of the manual/pneumatic pump structure of the present invention.
Figure 5:
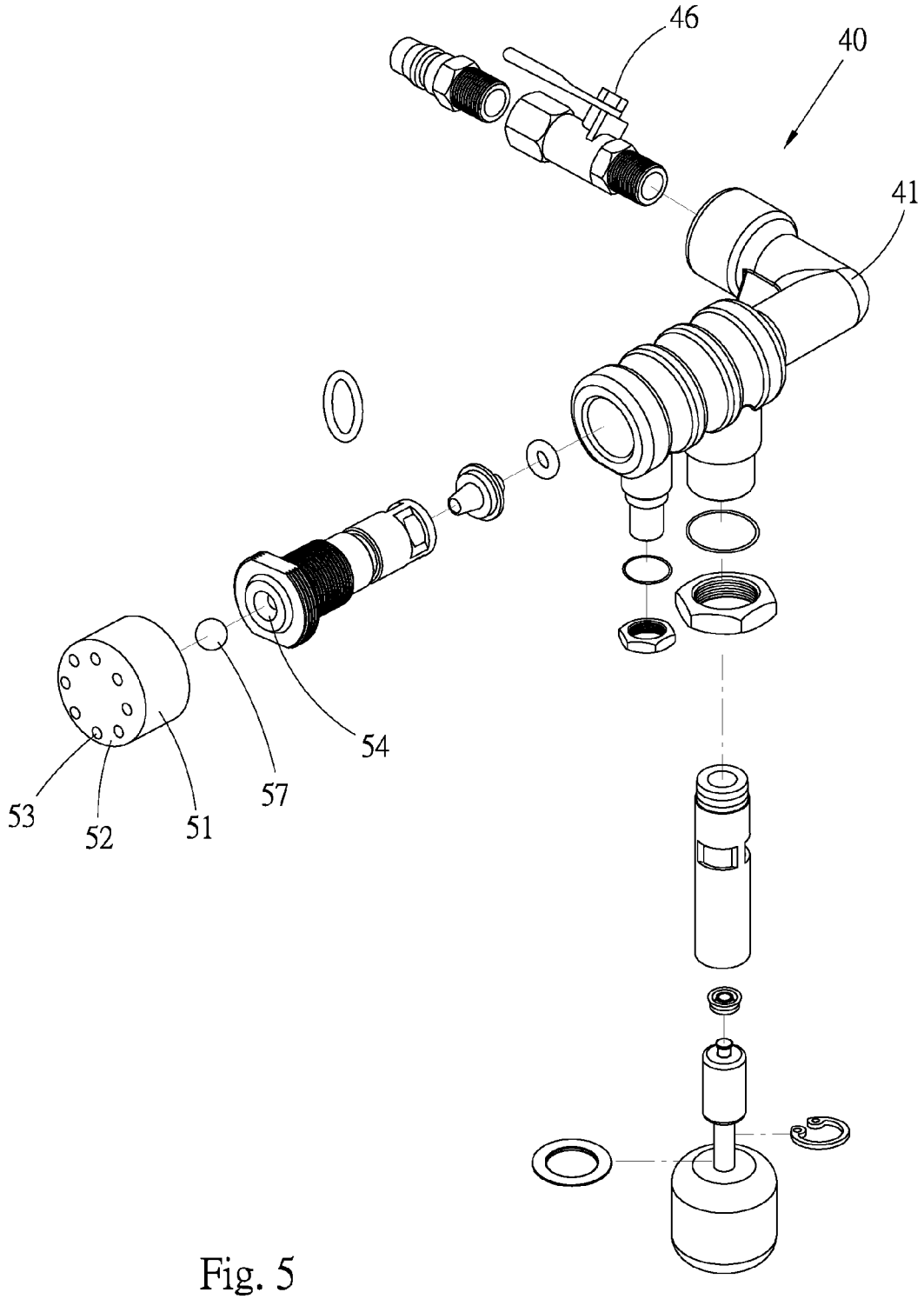
FIG. 5 is a perspective exploded view of a part of the preferred embodiment of the manual/pneumatic pump structure of the present invention.
Figure 6:
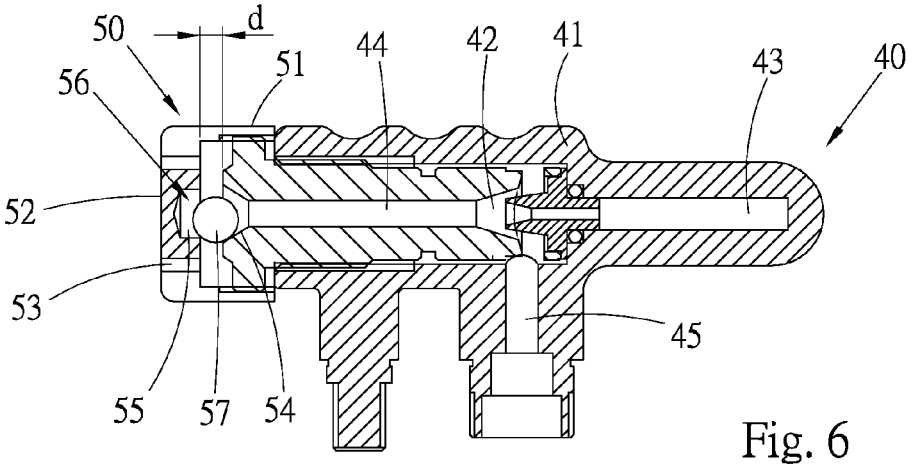
FIG. 6 is a sectional view of a part of the preferred embodiment of the manual/pneumatic pump structure of the present invention, showing the stopper body in a not operated state.

It should be noted that the manual/pneumatic pump has independent flow ways for manual operation mode and pneumatic operation mode respectively. It is necessary for the manual/pneumatic pump to ensure that one of the flow ways is blocked when the other is used. Therefore, in the above embodiments, when operated in the manual operation mode, the pneumatic gas-sucking flow way is blocked. Reversely, when operated in the pneumatic operation mode, the manual gas-sucking flow way must be blocked. This is achieved by a valve assembly 60 with a float member as shown in FIGS. 1 and 2. The valve assembly 60 is described hereinafter.

The valve assembly 60 includes a tubular sleeve member 61. One end of the sleeve member 61 is fixedly connected to the cover body 30 in coaxial communication with a manual intake (not shown). A shoulder section is formed on an inner circumference of the sleeve member 61. The valve assembly 60 further includes a ball member 63 and a spring 62. The spring 62 presses the ball member 63 against the shoulder section of the sleeve member 61. In normal state, the ball member 63 blocks the passage between the manual intake and the fuel collection space 22 to prevent the gas from reversely flowing through the manual intake into the fuel collection space 22. Accordingly, in the pneumatic operation mode, the atmosphere will not reversely flow through the manual intake into the fuel collection space 22. In this case, the fuel collection space 22 is kept in a low-pressure or vacuumed state.

It should be further noted that the manual/pneumatic pump is manually operated via a manual pump member 70. The manual pump member 70 serves to drive a piston 71 to suck the gas out of an inner tube 72 in communication with the fuel collection space 22. Accordingly, the gas in the fuel collection space 22 can be sucked out.

Figure 10:
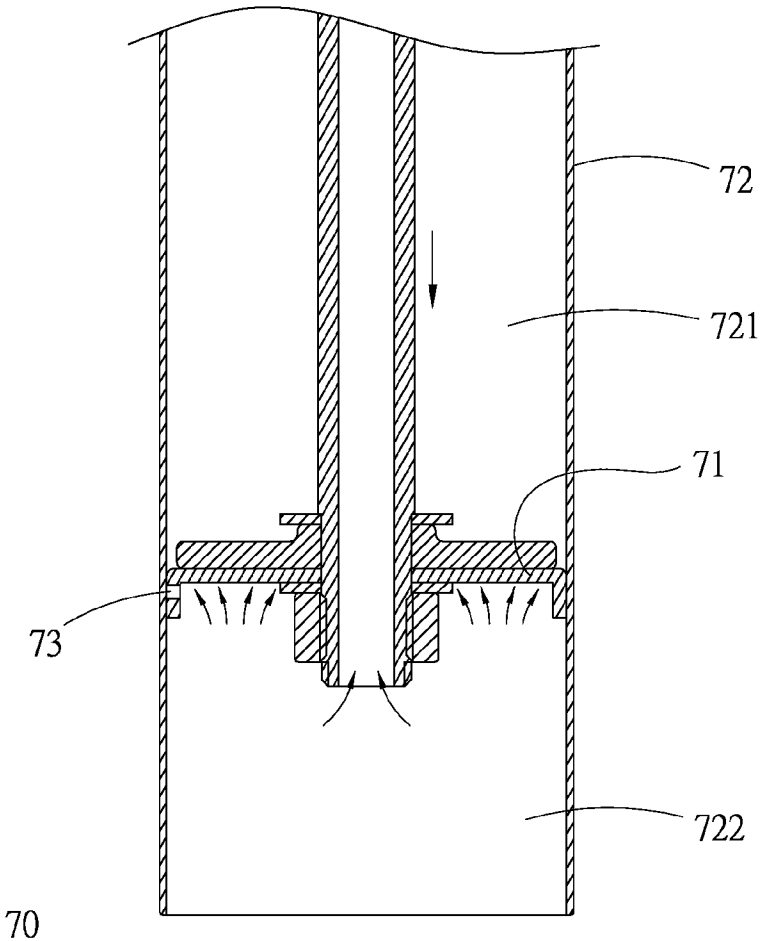
FIG. 10 is a sectional view of a part of the preferred embodiment of the manual/pneumatic pump structure of the present invention, showing the configuration of the piston of the manual pump member in a pressurized state.
Figure 9:
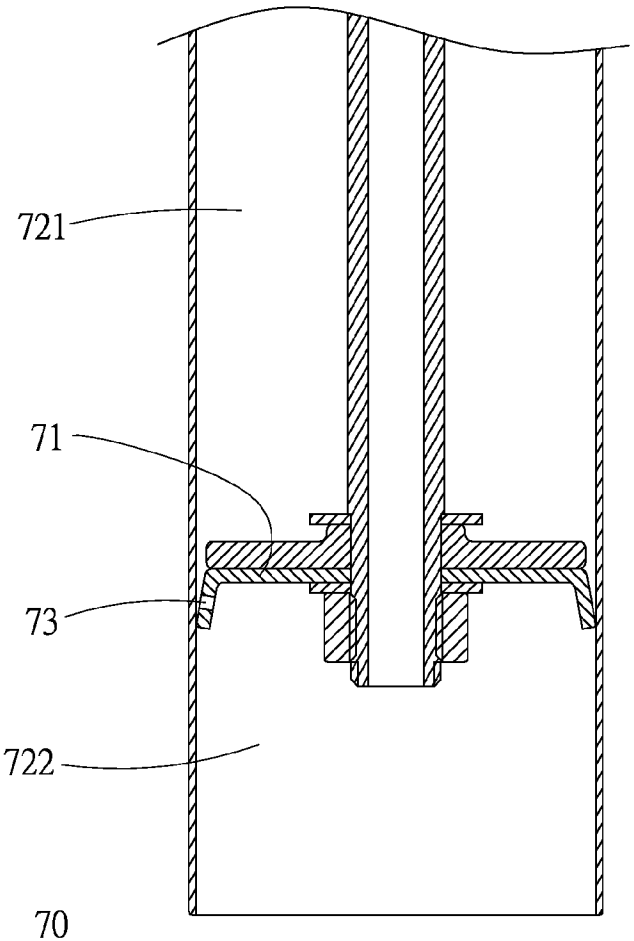
FIG. 9 is a sectional view of a part of the preferred embodiment of the manual/pneumatic pump structure of the present invention, showing the configuration of the piston of the manual pump member in a pressure-free state.

Please refer to FIGS. 9 and 10. The piston 71 isolates an upper space 721 above the piston 71 from a lower space 722 below the piston 71. After the piston 71 is forcedly moved downward to draw out the gas from the lower space 722, the upper and lower spaces 721, 722 have different pressure values. That is, the upper space 721 communicates with the fuel collection space 22 and the pressure of the upper space 21 generally drops down to a nearly zero value. The lower space 722 is in communication with the atmosphere. In general, the check valve serves to hinder the atmosphere from flowing in reverse direction. However, the lower space 722 still has a pressure value higher than that of the upper space 721. As a result, the piston 71 may be abruptly pushed upward to threaten the safety. To overcome this problem, one side of the piston 71 is formed with a small-diameter vent 73 to balance the air pressure of the upper space 721 with the air pressure of the lower space 722.

To speak more specifically, the vent 73 is formed on a deformable skirt section of the piston 71. When the piston 71 is forcedly moved downward to suck away the gas, the pressure of the lower space 722 rises to make the skirt section of the piston 71 tightly attach to the inner circumference of the inner tube 72. Under such circumstance, the vent 73 is blocked as shown in FIG. 10. When the abruptly rising pressure of the lower space 722 is relieved, the piston 71 is restored to its original state as shown in FIG. 9. Under such circumstance, the upper and lower spaces 721, 722 are in communication with each other via the vent 73 to balance the pressures.

The above embodiments are only used to illustrate the present invention, not intended to limit the scope thereof. Many modifications of the above embodiments can be made without departing from the spirit of the present invention.

What is claimed is:

1. A manual/pneumatic pump structure comprising:

a barrel member having a barrel body, the barrel body defining a fuel collection space with a top opening;

a cover body disposed on the barrel body for sealing the fuel collection space;

a pneumatic gas-sucking member having a main body disposed on the cover body and a Venturi tube section positioned in the main body, an inlet passage being formed in the main body in communication with an inlet of the Venturi tube section, an outlet passage being formed in the main body with a first end in communication with an outlet of the Venturi tube section, a second end of the outlet passage being permissible to communicate with the atmosphere as an opening, the main body being further formed with an intake, a first end of the intake communicating with a low-pressure section of the Venturi tube section, a second end of the intake communicating with the fuel collection space, a control section being used to control an opening and a closing of the inlet passage; and an isolation section for isolating an internal passage of the pneumatic gas-sucking member and the fuel collection space from the atmosphere, the manual/pneumatic pump structure being characterized in that the isolation section has a movement space with a predetermined capacity in communication with the outlet passage, a stopper body being received in the movement space, the stopper body having a volume smaller than the capacity of the movement space, whereby the stopper body is movable within the movement space between a blocking position and an unblocking position, when positioned in the blocking position, the stopper body blocking the outlet passage to isolate the outlet passage from the atmosphere, when positioned in the unblocking position, the stopper body unblocking the outlet passage, permitting the outlet passage to communicate with the atmosphere, wherein the isolation section includes a connection ring, a first axial end of the connection ring being serially connected with an end of the main body, where the opening of the outlet passage is formed, the isolation section further including an end piece fixedly connected with a second axial end of the connection ring to block the second axial end, an inner face of the end piece being opposite to and spaced from a face of the end of the main body by a gap, whereby the movement space is defined between the inner face of the end piece and the opening of the outlet passage for receiving the stopper body, wherein the stopper body has the form of a spherical body, the gap between the inner face of the end piece and the face of the end of the main body is smaller than a radius of the stopper body.

2. The manual/pneumatic pump structure as claimed in claim 1, wherein a tapered dent is formed on a circumferential wall of the opening of the outlet passage, the movement space being defined between the inner face of the end piece and the tapered dent, when the stopper body is positioned in the blocking position, the stopper body being inlaid in the tapered dent to block the opening of the outlet passage.

3. The manual/pneumatic pump structure as claimed in claim 2, wherein a blind hole is formed on the inner face of the end piece opposite to the tapered dent, the movement space being defined between the tapered dent and the blind hole.

4. The manual/pneumatic pump structure as claimed in claim 3, wherein the isolation section further includes a resilient member positioned between the end piece and the stopper body to provide resilient force for resiliently keeping the stopper body in the blocking position.

5. The manual/pneumatic pump structure as claimed in claim 2, wherein the isolation section further includes a resilient member positioned between the end piece and the stopper body to provide resilient force for resiliently keeping the stopper body in the blocking position.

* * * * *